United States Patent [19]

Nordin

[11] Patent Number: 4,712,743

[45] Date of Patent: Dec. 15, 1987

[54] CRUSHER GAP SETTING

[76] Inventor: Lee Nordin, 2403 Highpoint, Kotze Street, Hillbrow, Johannesburg, Transvaal, South Africa

[21] Appl. No.: 735,951

[22] Filed: May 20, 1985

[30] Foreign Application Priority Data

May 22, 1984 [ZA] South Africa ..... 84/3853

[51] Int. Cl.[4] ..... B07C 19/00

[52] U.S. Cl. ..... 241/30; 241/37

[58] Field of Search ..... 241/30, 33, 36, 35, 241/37

[56] References Cited

U.S. PATENT DOCUMENTS 4,295,420 10/1981 Satahe et al. ..... 241/37 X

*Primary Examiner*—Timothy V. Eley

*Attorney, Agent, or Firm*—Burns, Doane, Swecker & Mathis

[57] ABSTRACT

The amplitude of the variations in the power drawn by a crusher motor is dependent on the crushing gap in the crusher, other parameters such as ore feed rate etc. remaining constant. In accordance with the invention, this phenomenon is used to set the crushing gap. The power drawn by the motor is monitored and the amplitude of the variations of the power drawn is used as a basis for determining whether the existing crushing gap is too great or too small.

6 Claims, 4 Drawing Figures

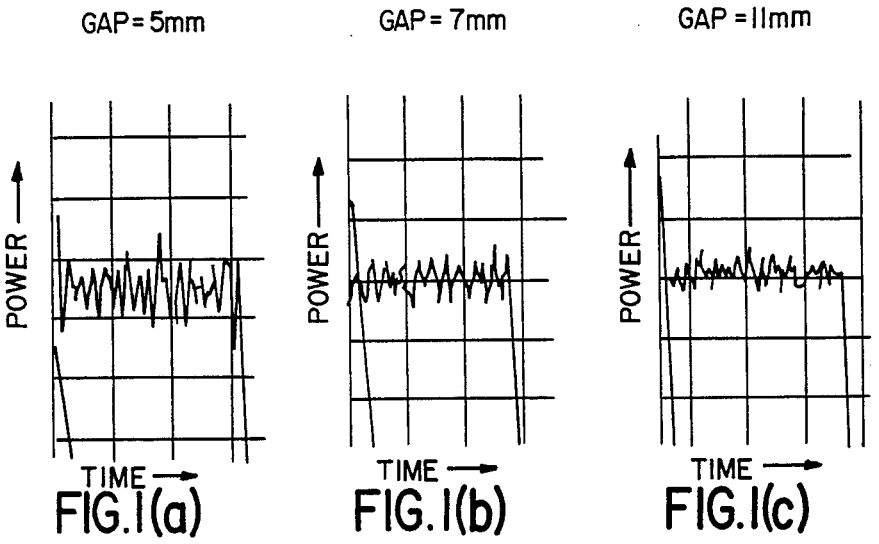
FIG. 1(a) FIG. 1(b) FIG. 1(c)
FIG. 2
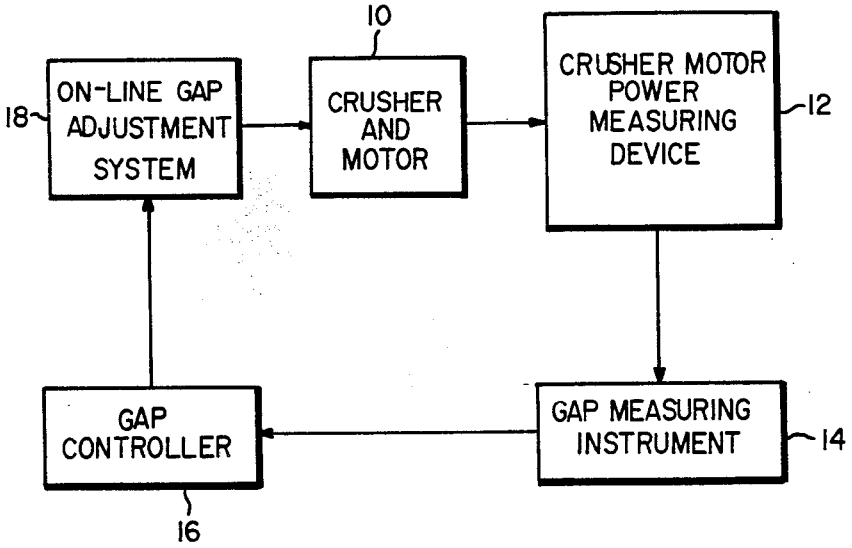

CRUSHER GAP SETTING

BACKGROUND TO THE INVENTION

This invention relates to the measuring and setting of the crushing gap in crushers, such as gyrating disc or cone crushers.

At present, the crushing gap is ascertained by leading. In the leading process, the crusher is stopped, and a lead body is dropped into the gap on a string. When the crusher is restarted, the lead is deformed to a thickness equal to the crushing gap. If the gap so ascertained is incorrect, it is necessary to reset it, and then to perform the leading process again to check the setting. The leading process may have to be performed over and over again until an acceptable gap is measured.

This unsophisticated, trial-and-error process has obvious drawbacks. For instance, it implementation leads to considerable downtime and the final result may still not be accurate. Also, it is not uncommon for the operator to neglect to do his checks at the required frequent intervals, with the result that the gap is often too great as wear of the crusher takes place. This in turn means that the rock is not crushed to the required size and may have to be returned for a further pass, and attendant reduced production and efficiency. Even more serious in the case of diamond-bearing rock is the fact that diamonds can be lost if the gap is too great.

Experiments conducted by the inventor revealed that the power drawn by a gyradisc crusher during operation is not constant, even if other operating parameters, such as ore feed rate and ore size, are kept constant, but exhibits considerable variations. Furthermore, it was found that the amplitude of the variations is greater if the crushing gap is small than if the crushing gap is larger.

It is an object of the invention to use these findings in the measuring and setting of the crusher's crushing gap.

SUMMARY OF THE INVENTION

In a method according to this invention, the crushing gap in a crusher is set in dependence on the amplitude of the variations in the power drawn by the crusher motor when operational.

In a preferred form, the method includes the following steps: monitoring the power drawn by the motor, determining the actual crushing gap by analysing the amplitude of the variations in the power drawn by the motor, comparing the actual crushing gap with a predetermined value, and adjusting the crushing gap according to whether, and by how much, the actual gap differs from the predetermined value.

Alternatively, the method may include the following steps: monitoring the power drawn by the motor, comparing the actual amplitude value, and adjusting the crushing gap in accordance with whether, and by how much, the actual amplitude differs from the predetermined value. In this case, if the actual amplitude is greater than the predetermined value, the crushing gap will be increased, and vice versa.

Preferably, the method of the invention is carried out continuously and automatically i.e. the power drawn is monitored continuously, and crushing gap adjustments are made automatically as required.

Preferred apparatus according to one embodiment of the invention includes means for monitoring the power drawn by the crusher motor, means for determining the actual crushing gap by analysing the amplitude of the variations in the power drawn, means for comparing the actual gap with a predetermined gap, and means for adjusting the actual gap in accordance with whether, and by how much, the actual gap differs from the predetermined gap.

Alternative apparatus may include means for monitoring the power drawn, means for comparing the amplitude of the variations in the power drawn with a predetermined amplitude value, and means for adjusting the actual gap in accordance with whether, and by how much, the actual amplitude differs from the predetermined value.

BRIEF DESCRIPTION OF THE DRAWINGS

FIGS. 1*a*, 1*b*, 1*c* show graphs of the power drawn by a gyradisc crusher for different crushing gap settings; and FIG. 2 illustrates schematically how the crushing gap can be set continuously to an optimum value.

DESCRIPTION OF AN EMBODIMENT

Referring firstly to FIG. 1, the power drawn characteristics recorded by a chart recorder in three different experiments with increasing crushing gaps are illustrated graphically in the form of waves representative of the power drawn by a crusher motor. In each case, other operating parameters, such as ore feed rate and ore size prior to crushing are kept constant. Power drawn is on the vertical axis, and time on the horizontal axis. In these experiments, the chart speed was 60 cm/h, and the graphs are at full scale. In the experiment represented by graph (a), the crushing gap was 5 mm, in that represented by graph (b) it was 7 mm, and in that represented by graph (c), it was 11 mm.

A comparison of the graphs readily indicates that the smaller the crushing gap, the greater the "noise" in the power drawn. "Noise" is the variations in the power drawn, and is represented by the wave amplitude of the graphs of FIGS. 1*a*, *b*, and *c*. Compare, for instance, graph (a) with graph (c), where it is seen that the amplitude of the variations in the power drawn is markedly greater in the case of the smaller gap than in the case of the large gap.

The invention contemplates using this phenomenon in the measuring of the actual gap and the resetting of that gap (if necessary) to an optimum value. FIG. 2 illustrates schematically the basic components in one form of apparatus which could be used to achieve this end.

In FIG. 2, a conventional crusher and motor combination is designated by the reference numeral 10. During operation, the power drawn by the motor is monitored continuously by a measuring instrument 12. An instrument 14 analyses the incoming power drawn signals and produces from them a measured gap signal which is indicative of the actual crushing gap and which is dependent on the amplitude of the variations in the power drawn by the motor. The measured gap signal is passed to a gap controller 16 which compares the actual measured gap with an ideal value and controls an on-line gap adjustment system 18 depending on whether, and by how much, its comparison reveals a difference between the actual and ideal gap values. Preferably, the gap adjustment system 18 will be capable of effecting continuous fine adjustments to the gap setting, so maintaining the crushing gap continuously at an optimum value.

Note that the apparatus shown schematically in FIG. 2 effects its adjustments as a result of a comparison between a computed actual gap value and an ideal gap value. It would also be possible to have an apparatus which does not compute an actual gap value, but which performs a direct comparison between the ideal amplitude of the variations in the power drawn with an ideal amplitude value, and then performs its adjusting function on the basis of that comparison.

I claim:

1. A method of maintaining a predetermined size of crushing gap in an ore crusher of the type comprising crusher means defining an adjustable crushing gap, and a driving motor for driving said crusher means, said method comprising the steps of:

establishing a predetermined gap size, measuring noise in the power drawn by said motor during a crushing operation, which measured noise is indicative of the size of said crushing gap, setting said crushing gap at said predetermined gap size in accordance with said measured noise, and maintaining the crushing gap at said predetermined gap size.

2. A method of maintaining a predetermined size of crushing gap in an ore crusher of the type comprising crusher means defining an adjustable crushing gap, and a drive motor for driving said crusher means, said method comprising the steps of:

establishing a predetermined gap size;

monitoring the power drawn by said motor during a crushing operation while keeping parameters of ore size and ore feed rate substantially constant;

measuring noise in the power drawn by the motor during such operation;

determining from the measured noise a measured size of said crushing gap;

comparing said measured gap size with said predetermined gap size;

adjusting the size of said crushing gap in accordance with a difference between said measured and predetermined gap sizes to maintain said predetermined gap size; and maintaining the crushing gap at said predetermined gap size.

3. A method of maintaining a predetermined size of crushing gap in an ore crusher of the type comprising crusher means defining an adjustable crushing gap, and a drive motor for driving said crusher means, said method comprising the steps of:

establishing a predetermined gap size;

monitoring the power drawn by said motor during a crushing operation while keeping parameters of ore size and ore feed rate substantially constant;

measuring noise in the power drawn by the motor during such operation;

comparing said measured noise with a predetermined noise value corresponding to said predetermined gap size;

adjusting the size of said crushing gap in accordance with a difference between said measured noise and said predetermined noise value to maintain said predetermined gap size; and maintaining the crushing gap at said predetermined gap size.

4. In an ore crusher of the type comprising crusher means defining an adjustable crushing gap and a drive motor for driving said crusher means, the improvement comprising means for monitoring the power drawn by said motor during a crushing operation, and for measuring noise in the power drawn by the motor, and means for setting the crushing gap size to a predetermined gap size in accordance with the measured noise.

5. In an ore crusher of the type comprising crusher means defining an adjustable crushing gap and a drive motor for driving said crusher means, the improvement comprising:

means for monitoring the power drawn by said motor during a crushing operation while keeping parameters of ore size and ore feed rate substantially constant;

means for measuring noise in the power drawn by the motor during such operation;

means for determining from the measured noise a measured size of said crushing gap;

means for comparing said measured gap size with a predetermined gap; and means for adjusting the size of said crushing gap in accordance with a difference between said measured and predetermined gap sizes to maintain said predetermined gap size.

6. In an ore crusher of the type comprising crusher means defining an adjustable crushing gap on a drive motor for driving said crusher means, the improvement comprising:

means for monitoring the power drawn by said motor during a crushing operation while keeping parameters of ore size and ore feed rate substantially constant;

means for measuring noise in the power drawn by the motor during such operation;

means for comparing the measured noise with a predetermined noise value corresponding to a predetermined gap size; and means for adjusting the size of said crushing gap in accordance with a difference between said measured noise and said predetermined noise value to maintain said predetermined gap size.

* * * * *